US007775193B2

(12) United States Patent
Merz et al.

(10) Patent No.: US 7,775,193 B2
(45) Date of Patent: Aug. 17, 2010

(54) HIGH-PRESSURE PUMP, IN PARTICULAR FOR A FUEL INJECTION SYSTEM OF AN INTERNAL COMBUSTION ENGINE

(75) Inventors: Armin Merz, Weinstadt (DE); Gerhard Meier, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 446 days.

(21) Appl. No.: 10/586,871

(22) PCT Filed: Nov. 23, 2004

(86) PCT No.: PCT/DE2004/002584

§ 371 (c)(1),
(2), (4) Date: Jul. 21, 2006

(87) PCT Pub. No.: WO2005/073554

PCT Pub. Date: Aug. 11, 2005

(65) Prior Publication Data

US 2007/0154326 A1 Jul. 5, 2007

(30) Foreign Application Priority Data

Jan. 30, 2004 (DE) ..... 10 2004 004 705

(51) Int. Cl.
*F02M 37/04* (2006.01)

(52) U.S. Cl. ..... 123/495; 417/205

(58) Field of Classification Search ..... 417/387, 417/388, 499, 540, 390, 222.1, 269, 383, 417/386, 413.1, 494, 432, 289, 273, 205; 92/79, 60, 154, 168; 105/96.1; 123/446, 123/449, 299, 305, 301, 679, 495; *F02M 37/04*
See application file for complete search history.

(56) References Cited

U.S. PATENT DOCUMENTS

| | | | | |
|---|---|---|---|---|
| 2,301,407 | A * | 11/1942 | Houser et al. | 417/387 |
| 2,351,908 | A * | 6/1944 | Beeh | 417/494 |
| 4,008,009 | A * | 2/1977 | Kovacs et al. | 417/387 |
| 4,635,535 | A | 1/1987 | Thoma et al. | |
| 5,980,214 | A | 11/1999 | Djordjevic | |
| 6,264,437 | B1 * | 7/2001 | Porel | 417/390 |
| 6,764,285 | B1 | 7/2004 | Kellner | |

FOREIGN PATENT DOCUMENTS

| | | |
|---|---|---|
| DE | 199 07 311 A1 | 8/2000 |
| WO | WO 82/03253 A1 | 9/1982 |

* cited by examiner

*Primary Examiner*—Stephen K Cronin
*Assistant Examiner*—Keith Coleman
(74) *Attorney, Agent, or Firm*—Ronald E. Greigg

(57) ABSTRACT

A high-pressure pump having a housing containing at least one pump element that has a pump piston driven by a drive shaft; the piston is guided so that it can slide in a cylinder bore of a housing part and delimits a pumping chamber therein. A support element supports the pump piston against the drive shaft; and a prestressed return spring acts on both the pump piston and the support element in the direction toward the drive shaft. The support element is guided so that it can slide in a receptacle, which is contained in the housing part that also contains the cylinder bore, in the direction of the longitudinal axis of the pump piston, but cannot rotate around the longitudinal axis.

7 Claims, 3 Drawing Sheets

HIGH-PRESSURE PUMP, IN PARTICULAR FOR A FUEL INJECTION SYSTEM OF AN INTERNAL COMBUSTION ENGINE

CROSS-REFERENCE TO RELATED APPLICATIONS

This application is a 35 USC 371 application of PCT/DE 2004/002584 filed on Nov. 23, 2004.

BACKGROUND OF THE INVENTION

1. Field of the Invention

The invention is directed to an improved high-pressure pump for a fuel injection system of an internal combustion engine 2. Description of the Prior Art A high-pressure pump known from DE 199 07 311 A1 has a housing and several pump elements situated in the housing. Each of the pump elements has pump piston that is set into a stroke motion by a drive shaft of the high-pressure pump. The pump piston is guided in a sealed fashion in a cylinder bore of housing part of the high-pressure pump and delimits a pumping chamber in the cylinder bore. The pump piston is supported against the drive shaft by means of a support element in the form of a tappet. A prestressed return spring acts on the pump piston in the direction of the tappet and acts on the tappet in the direction of the drive shaft. A roller is supported in the tappet in rolling fashion and supports the tappet against a cam of the drive shaft. The tappet is guided so that it can slide in a bore contained in another housing part of the high-pressure pump separate from the housing part containing the cylinder bore; the bore and the tappet have a significantly larger diameter than the cylinder bore. A disadvantage of this known high-pressure pump is that the cylinder bore in which the pump piston is guided and the bore in which the tappet is guided are contained in separate housing parts so that assuring an exact alignment of the cylinder bore and the bore for the tappet requires complex centering measures to align the housing parts in relation to each other. In addition, because of its large diameter, the tappet is heavy, which in turn requires a very rigid and therefore heavy return spring in order to prevent the tappet from lifting up from the drive shaft at high speeds, which results in the high-pressure pump being heavy as a whole.

SUMMARY AND ADVANTAGES OF THE INVENTION

The high-pressure pump according to the invention has the advantage over the prior art that the cylinder bore for the pump piston and the receptacle for the support element are contained in the same housing part, thus requiring no complex centering measures during assembly of the high-pressure pump. In addition, the support element can be compactly embodied, which allows it to be light in weight, and the return spring can be embodied with a correspondingly low rigidity, as a result of which the weight of the high-pressure pump can be kept to a minimum.

Advantageous embodiments and modifications of the high-pressure pump according to the present invention are disclosed. The receptacle according to one embodiment is especially simple to manufacture.

BRIEF DESCRIPTION OF THE DRAWINGS

Two exemplary embodiments of the invention are described in detail herein below, with reference to the drawings, in which.

DESCRIPTION OF THE PREFERRED EMBODIMENTS

Figure 1:
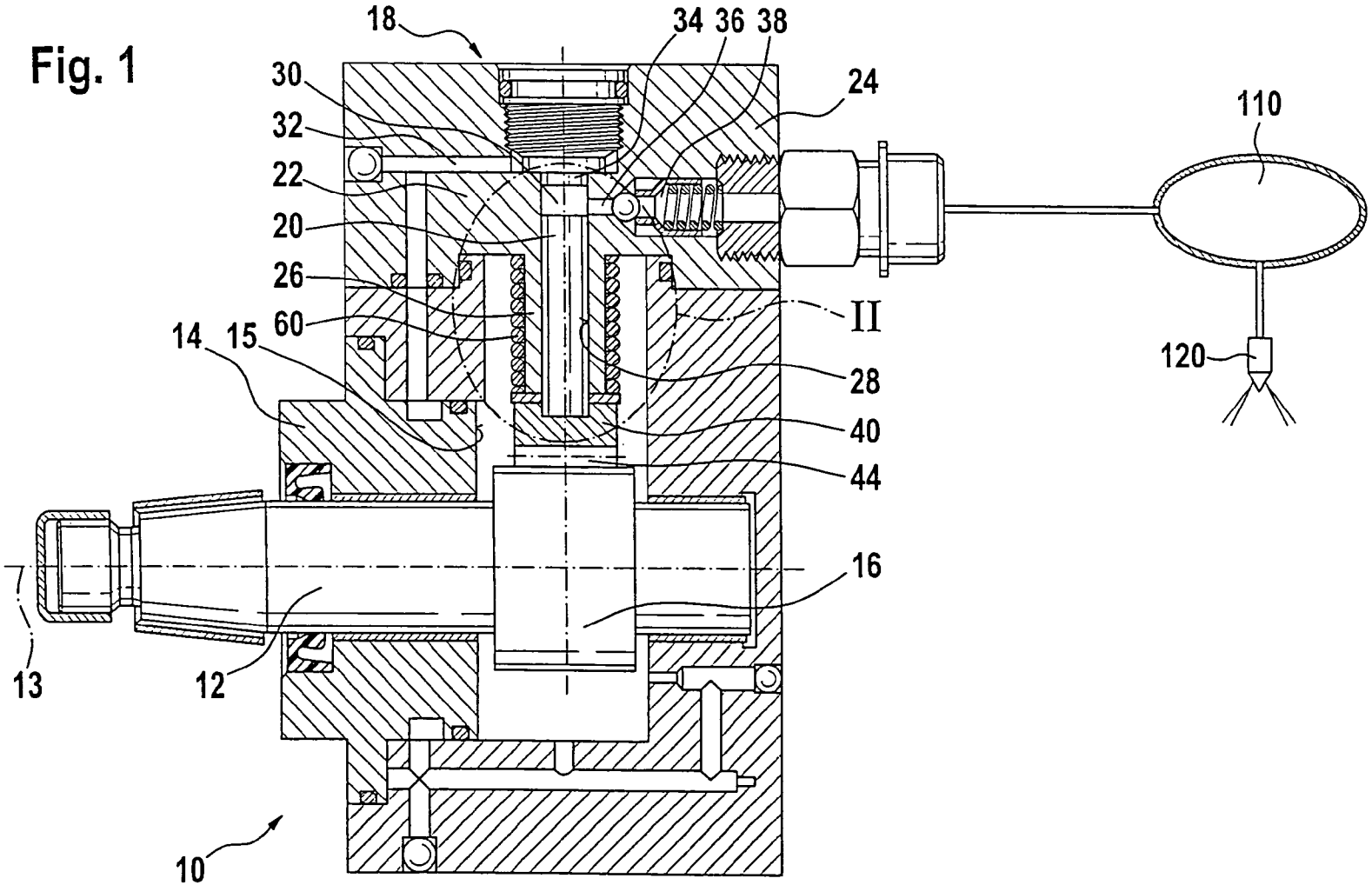
FIG. 1 shows a longitudinal section through a high-pressure pump for a fuel injection system of an internal combustion engine according to the present invention.

FIGS. 1 through 5 show a high-pressure pump for a fuel injection system of an internal combustion engine. The high-pressure pump has a multi-part housing 10 that contains a drive shaft 12 that can be driven to rotate by the internal combustion engine. The drive shaft 12 is supported in rotary fashion in a base body 14 of the housing 10 by means of two bearing points spaced apart from each other in the direction of the rotation axis 13 of the drive shaft 12. The base body 14 of the housing 10 can in turn be embodied of several parts and the bearing points can be provided in different parts of the base body 14.

In a region between the two bearing points, the drive shaft 12 has at least one cam 16; the cam 16 can also be embodied in the form of a multiple cam. The high-pressure pump has one or more pump elements 18 contained in the housing 10, each connected to a pump piston 20 that the cam 16 of the drive shaft 12 sets into a stroke motion in an at least approximately radial direction in relation to the rotation axis 13 of the drive shaft 12. In the region of each pump element 18, a housing part 22 is provided, which is connected to the base body 14 and is embodied in the form of a cylinder head. The housing part 22 has a flange 24 resting against an outside of the base body 14 and an at least approximately cylindrical extension 26 whose diameter is smaller than that of the flange 24 and protrudes through an opening 15 in the base body 14 toward the drive shaft 12. The pump piston 20 is guided in a sealed fashion in the housing part 22, inside a cylinder bore 28 contained in the extension 26 and delimits a pumping chamber 30 in the cylinder bore 28 with its end surface oriented away from the drive shaft 12. The cylinder bore 28 can extend into the flange 24 that contains the pumping chamber 30. A fuel supply conduit 32 extending in the housing 10 connects the pumping chamber 30 to a fuel inlet, for example from a fuel supply pump. An inlet valve 34 that opens into the pumping chamber 30 is situated at the junction point of the fuel inlet conduit 32 and the pumping chamber 30. The pumping chamber 30 is also connected via a fuel outlet conduit 36 extending in the housing 10 to an outlet that is connected, for example, to a high-pressure reservoir 110. The high-pressure reservoir 110 is connected to one or preferably several injectors 120 that are provided at the cylinders of the internal combustion engine and inject the fuel into the cylinders of the engine. An outlet valve 38 that opens out from the pumping chamber 30 is situated at the junction point of the fuel outlet conduit 36 and the pumping chamber 30.

A support element 40 is situated between the pump piston 20 and the cam 16 of the drive shaft 12. On its side oriented toward the cam 16, the support element 40 has a concave recess 42 in which a cylindrical roller 44 is supported in rotary fashion. The rotation axis 45 of the roller 44 is at least approximately parallel to the rotation axis 13 of the drive shaft 12 and the roller 44 rolls against the cam 16 of the drive shaft 12. The support element 40 is guided so that it can slide in a receptacle 46 of the housing part 22 in the direction of the stroke motion of the pump piston 20, i.e. along its longitudinal axis 21.

Figure 2:
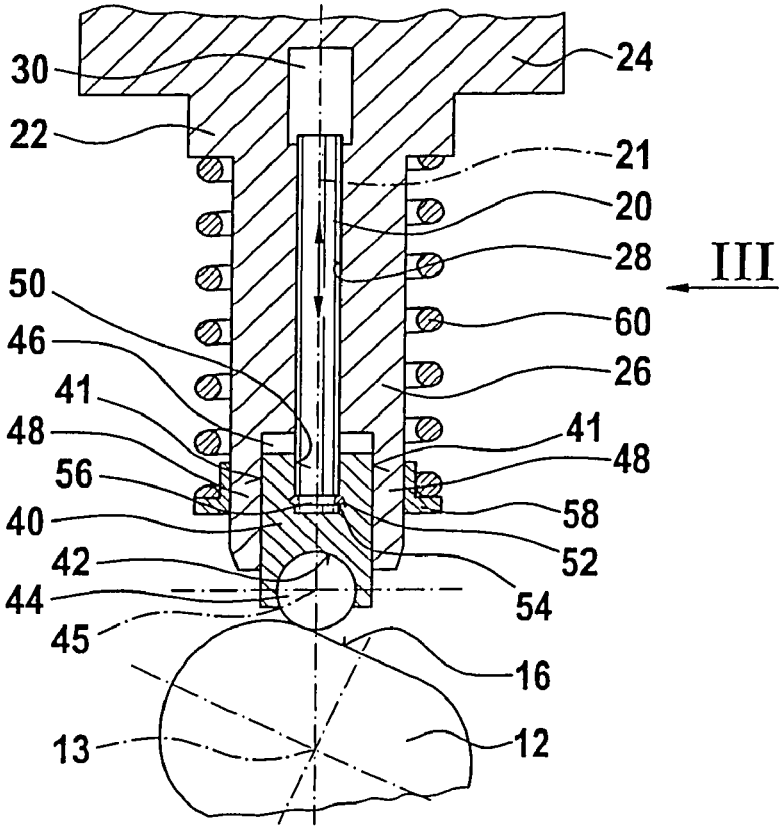
FIG. 2 shows an enlarged detail labeled II in FIG. 1 of the section of the high-pressure pump according to a first exemplary embodiment.
Figure 3:
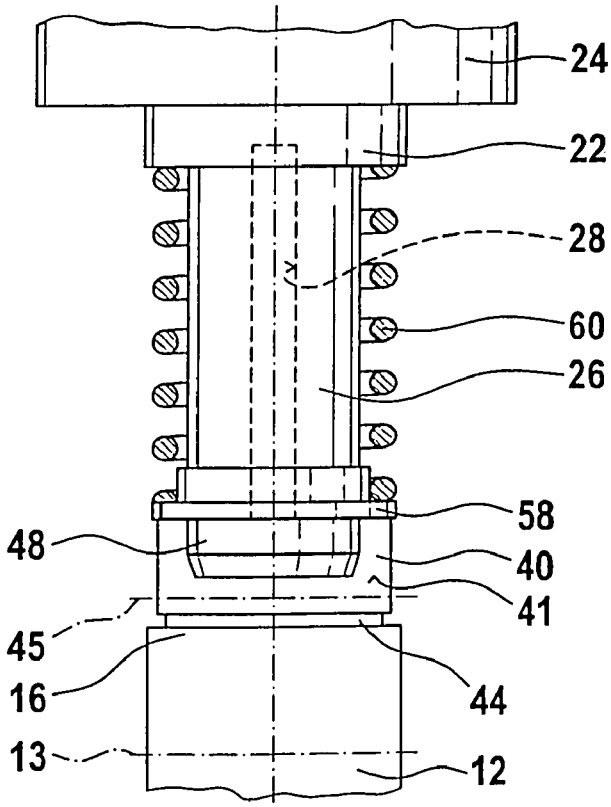
FIG. 3 shows the section II viewed in the direction of arrow III in FIG. 2.

FIGS. 2 and 3 show the high-pressure pump according to a first exemplary embodiment. The receptacle 46 for the support element 40 is embodied here in the form of a slot in the extension 26 of the housing part 22, which slot is connected to the cylinder bore 28 and extends to the end surface of the extension 26 oriented toward the drive shaft 12. The slot 46 is delimited by two walls 48 of the extension 26 extending at least approximately parallel to each other. The support element 40 is embodied as at least approximately rectangular in cross-section and is situated between the two walls 48 with a slight amount of play. The surfaces of the walls 48 oriented toward the support element 40 and/or the surfaces 41 of the support element 40 oriented toward the walls 48 are preferably machined in such a way that they are flat and have a low degree of surface roughness, for example the surfaces are ground. The support element 40 is guided so that it can slide between the parallel walls 48, in the direction of the longitudinal axis 21 of the pump piston 20, but cannot rotate in relation to the longitudinal axis 21.

The pump piston 20 is coupled to the support element 40 in the direction of its longitudinal axis 21. The support element 40 can, for example, have a bore 50 on its side oriented toward the pump piston 20, into which the pump piston 20 protrudes. The circumference of the bore 50 has an annular groove 52 into which a radially elastic spring clip 54 is inserted. The pump piston 20 also has an annular groove 56 in its end region, in which the spring clip 54 engages in detent fashion when the pump piston 20 is inserted into the bore 50, thus achieving the coupling between the pump piston 20 and the support element 40.

The support element 40 protrudes through the slot 46, laterally out from the extension 26 and a spring plate 58 rests against the ends of the support element 40 protruding out from the slot 46. The spring plate 58 can be attached to the support element 40, for example by means of a detent connection. A prestressed return spring 60, which can be embodied in the form of a helical compression spring that encompasses the extension 26, is situated between the spring plate 58 and the housing part 22. The return spring 60 acts on the support element 40 and the pump piston 20 coupled to it in the direction of the cam 16 of the drive shaft 12 so as to assure the contact of the roller 44 against the cam 16 even during the intake stroke of the pump piston 20 oriented toward the drive shaft 12 and even at high speeds of the drive shaft 12.

During the intake stroke of the pump piston 20, in which it moves radially inward, the pumping chamber 30 is filled with fuel from the fuel inlet conduit 32 when the inlet valve 34 is open and the outlet valve 38 is closed. During the delivery stroke of the pump piston 20 in which it moves radially outward, the pump piston 20 delivers highly pressurized fuel to the high-pressure reservoir 110 through the fuel outlet conduit 36 when the outlet valve 38 is open and the inlet valve 34 is closed. The support element 40 is guided in the receptacle 46 in such a way as to prevent it from rotating around the longitudinal axis 21 of the pump piston 20 and absorbs any lateral forces that occur so that they do not act on the pump piston 20. The receptacle 46 can be aligned very precisely in relation to the cylinder bore 28 since it is provided in the same housing part 22 as the cylinder bore 28. The support element 40 can be compactly designed since it only needs to contain the recess 42 for accommodating the roller 44 and is guided by means of its lateral, flat surfaces 41. It is easily possible to manufacture the rectangular support element 40 and the slot 46 as a receptacle for the support element 40.

Figure 4:
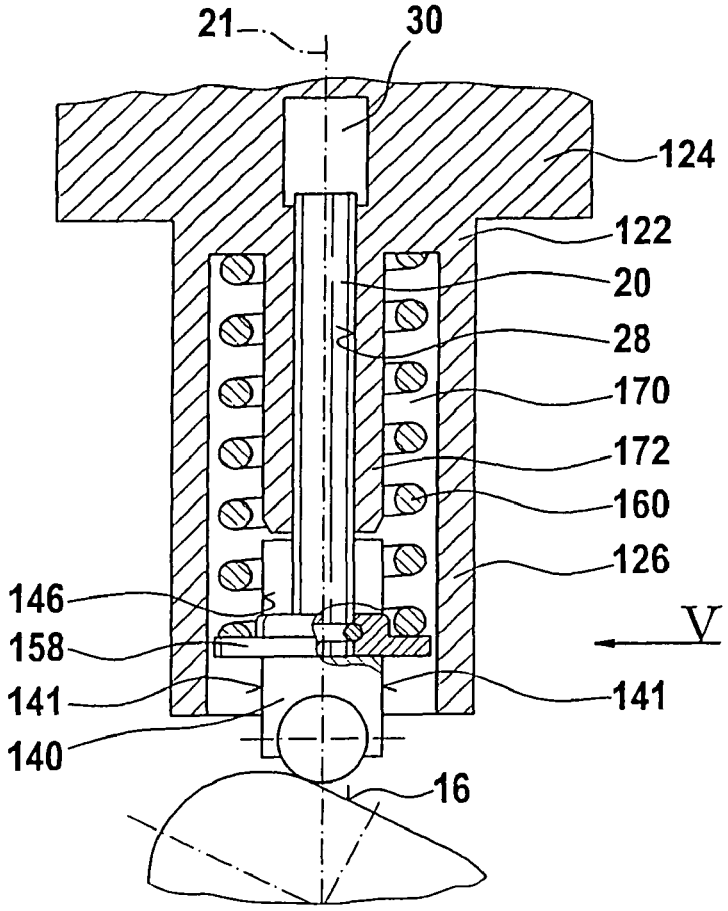
FIG. 4 shows the section II of the high-pressure pump according to a second exemplary embodiment.
Figure 5:
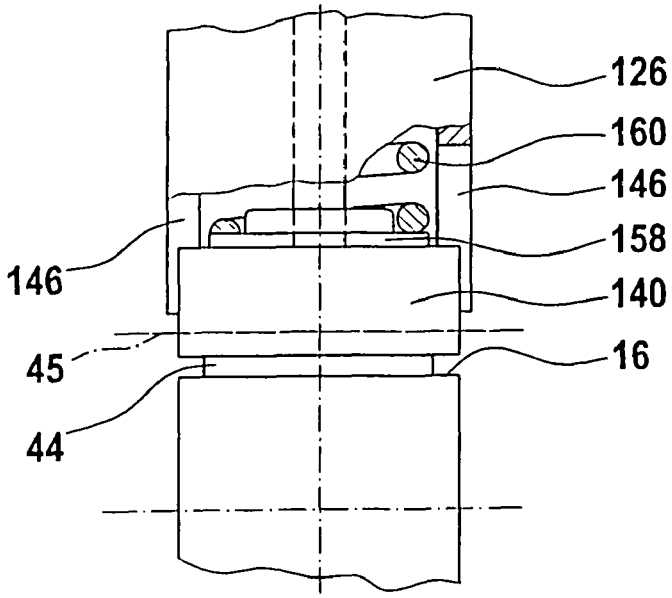
FIG. 5 shows the section viewed in the direction of arrow V in FIG. 4.

FIGS. 4 and 5 show details of the high-pressure pump according to a second exemplary embodiment in which the basic design of the high-pressure pump remains unchanged in relation to the first exemplary embodiment and only the housing part 22 is modified. The housing part 122 has the flange 124 and the cylindrical extension 126 protruding from it. The end surface of the extension 126 oriented away from the drive shaft 12 is provided with an annular groove 170, which, inside the extension 126, forms an inner, at least approximately cylindrical extension 172 that contains the cylindrical bore 28 in which the pump piston 20 is guided. The depth of the annular groove 170 extends approximately to the flange 124 of the housing part 122. The inner extension 172 ends spaced further apart from the drive shaft 12 than the outer extension 126; in its end region protruding beyond the inner extension 172, the outer extension 126 has two diametrically opposed slots 146. The support element 140 is at least approximately rectangular in cross section, is situated in the end region of the outer extension 126 protruding beyond the inner extension 172, and protrudes with its lateral ends into the slots 146. By means of its flat side surfaces 141 that protrude into the slots 146, the support element 140 is guided so it can slide in the direction of the stroke motion of the pump piston 20 in a receptacle for it that is comprised of the slots 146 in the outer extension 126. As in the first exemplary embodiment, the pump piston 20 can be coupled to the support element 140. A return spring 160, which is supported at the bottom of the annular groove 170, is supported in a prestressed fashion against a spring plate 158, which in turn rests against the support element 140. The spring plate 158 can be connected to the support element 140, for example by means of a detent connection. The return spring 160 is contained in the annular groove 170 and encompasses the inner extension 172. Alternatively, the spring plate 158 can also be supported on the pump piston 20, for example by means of a securing ring, or on a larger diameter piston base of the pump piston 20. The pump piston 20 here is held in contact with the support element 140 by the return spring 160 and does not need to be additionally coupled to the support element 140.

The foregoing relates to a preferred exemplary embodiment of the invention, it being understood that other variants and embodiments thereof are possible within the spirit and scope of the invention, the latter being defined by the appended claims.

The invention claimed is:

1. A high-pressure pump for a fuel injection system of an internal combustion engine, the pump comprising a housing with at least one pump element including a pump piston driven into a stroke motion by a drive shaft;

the pump piston being guided so that it can slide in a cylinder bore of a housing part and delimiting a pumping chamber therein;

a support element supporting the pump piston against the drive shaft;

a prestressed return spring acting on both the pump piston and the support element in the direction toward the drive shaft;

a receptacle contained in the same housing part that contains the cylinder bore;

the housing part comprising an extension that is at least approximately cylindrical, is oriented toward the drive shaft, and contains the cylinder bore and the receptacle, an end of the cylinder bore oriented toward the drive shaft terminates at a plane containing a wall of the receptacle;

the receptacle being embodied in the form of at least one slot in the extension of the housing part extending to an end surface of the extension oriented toward the drive shaft, the at least one slot being delimited by two walls extending at least approximately parallel to each other;

the support element being embodied as at least approximately rectangular in cross section and situated in the receptacle between the two walls of the slot; and the support element being guided so that it can slide between the two walls of the at least one slot in the receptacle in the direction of the longitudinal axis of the pump piston, but cannot rotate around the longitudinal axis.

2. The high-pressure pump according to claim 1, wherein the return spring is a helical compression spring encompassing the extension of the housing.

3. The high-pressure pump according to claim 1, wherein the return spring is supported at least indirectly against the support element; and wherein the pump piston is coupled to the support element in the direction of its longitudinal axis.

4. A high-pressure pump for a fuel injection system of an internal combustion engine, the pump comprising a housing with at least one pump element including a pump piston driven into a stroke motion by a drive shaft;

the pump piston being guided so that it can slide in a cylinder bore of a housing part and delimiting a pumping chamber therein;

a support element supporting the pump piston against the drive shaft;

a prestressed return spring acting on both the pump piston and the support element in the direction toward the drive shaft;

a receptacle contained in the same housing part that contains the cylinder bore;

the housing part comprising an extension that is at least approximately cylindrical, is oriented toward the drive shaft, and contains the cylinder bore and the receptacle, an end of the cylinder bore oriented toward the drive shaft terminates at a plane containing a wall of the receptacle, the support element being guided so that it can slide in the receptacle in the direction of the longitudinal axis of the pump piston, but cannot rotate around the longitudinal axis, and the return spring being a helical compression spring encompassing the extension of the housing part.

5. The high-pressure pump according to claim 4, wherein the return spring is supported at least indirectly against the support element; and wherein the pump piston is coupled to the support element in the direction of its longitudinal axis.

6. The high-pressure pump according to claim 4, wherein the receptacle is embodied in the form of at least one slot provided in the housing part.

7. The high-pressure pump according to claim 4, wherein the support element is embodied as at least approximately rectangular in cross section.

* * * * *